United States Patent [19]

Benkovsky

[11] 4,381,574

[45] May 3, 1983

[54] PORTABLE GOLF BALL WASHER

[76] Inventor: Michael Benkovsky, Lee Park Towers, Apt. 622, Wilkes Barre, Pa. 18702

[21] Appl. No.: 331,075

[22] Filed: Dec. 15, 1981

[51] Int. Cl.[3] ..... A63B 47/04

[52] U.S. Cl. ..... 15/97 R; 15/21 A

[58] Field of Search ..... 15/21 A, 97 R; 134/6

[56] References Cited

U.S. PATENT DOCUMENTS

| | | | |
|---|---|---|---|
| 1,500,681 | 7/1924 | Mudra | 15/21 A |
| 2,031,633 | 2/1936 | Brillhart | 15/21 A |
| 3,103,677 | 9/1963 | Gallant | 15/21 A |

FOREIGN PATENT DOCUMENTS

| | | | |
|---|---|---|---|
| 625398 | 8/1961 | Canada | 15/21 A |

*Primary Examiner*—Edward L. Roberts

*Attorney, Agent, or Firm*—Anthony J. Dixon

[57] ABSTRACT

A portable, motor operated, golf ball washing device which comprises a liquid retaining foam lined receptacle which rotates over the surface of a golf ball restrained in one position whereby the ball is cleaned without the need for manual application of force; said device suitable for carrying on golf bag or cart by means of a spring-clip or the like.

5 Claims, 4 Drawing Figures

PORTABLE GOLF BALL WASHER

BACKGROUND OF THE INVENTION

I. Field of the Invention

The present invention relates to devices for washing golf balls. More particularly it relates to golf ball washers which are portable and which can be carried by the golfer on his person, or his golf bag or on a golf cart and, which is motorized; as opposed to presently available fixed location, manually operated golf ball washers.

II. The Prior Art

The field of golf ball washers is predominantly related to the devices which have a fixed, permanent location and which are operated manually by the user's own power.

Refinements in the field have disclosed golf ball washers which can be carried from place to place by the user but these washers are all manually operated on a plunger technique.

Such devices can be seen in U.S. Pat. No. 3,678,526 issued to Burkholder which is a manually operated plunger type device.

Further disclosures such as U.S. Pat. No. 3,508,016 issued to J. A. McConnell show portable devices but these also are plunger-type devices which are manually operated.

Rotary type actions are seen on fixed location washers such as J. Procario in U.S. Pat. No. 2,744,274 and G. A. Brillhart in U.S. Pat. No. 2,031,633 but neither device is portable in a convenient fashion and these devices are crank or manually operated.

The need still exists for a portable rotary type cleaner which is not hand operated.

The disadvantages to the fixed location washers is in their location itself and therefore only available to the golfer on a limited basis.

It is advantageous therefore to provide a portable, rotary type, power operated ball washer which is easy to maintain, inexpensive to construct and therefore available to the golfer at any point on the course.

III. SUMMARY OF THE INVENTION

It is therefore an object of the present invention to provide an improved golf ball washing device which is motor operated and portable.

It is a further object of the present invention to provide a rotary motion golf ball cleaner which is easily portable and which can be clipped to the users belt, golf bag or golf cart.

It is a further object of the invention to provide a round golf ball washer which does not rely on manual power to operate it but rather is motor operated upon insertion of the ball to be washed.

It is still a further object of the present invention to augment the limited golf ball washing areas on today's golf courses by the provision of a highly portable, motorized rotary action golf ball washer which will be economical to manufacture and which is efficient in operation.

These and other objects of the present invention will be apparent to one skilled in the art from a further study of the present specification, drawings referred to herein and the appended claims.

In accordance with the present invention there is provided an improved, motorized, portable golf ball cleaning device which comprises (a) a case having a lower section and an upper section, (b) a receptacle in said upper section which is accessable from the top of said upper section, (c) a hinged door on said upper section which seals said receptacle when closed, (d) a generally cylindrical water-tight ball holder which is rotatably mounted in said receptacle which contains a liquid retaining foam liner, (e) a motor mounted in the lower section of said case, (f) means for transmitting said motor rotation to said ball holder, (g) means for supplying power to said motor through a circuit, (h) a switch which is in the circuit and which is open when said door is open and closed to complete the circuit when said door is closed, (i) means for restraining the motion of a golf ball placed in the holder whereby a golf ball is placed in said holder, said door is closed thereby completing the circuit causing the motor to turn which in turn rotates the holder so that the liquid retaining foam liner moves over the surface of the ball thereby cleaning the ball.

The invention further provides means for attaching the holder to a golf bag, cart or belt by means of a clip mounted on the case.

It is envisioned that the transmission means will be a shaft or the like and that the restraining means will be a rubber like cup mounted inside the door so as to frictionally restrain movement of the ball to allow the receptacle to revolve around it thereby accomplishing the desired cleaning result.

A small quantity of any conventional liquid cleaning material can be impregnated in the foam liner so as to facilitate cleaning without the risk of spills.

Further details and advantages of the invention will be more particularly set forth in the drawings and descriptions of the preferred embodiment which follows:

DESCRIPTION OF THE PREFERRED EMBODIMENT

Figure 1:
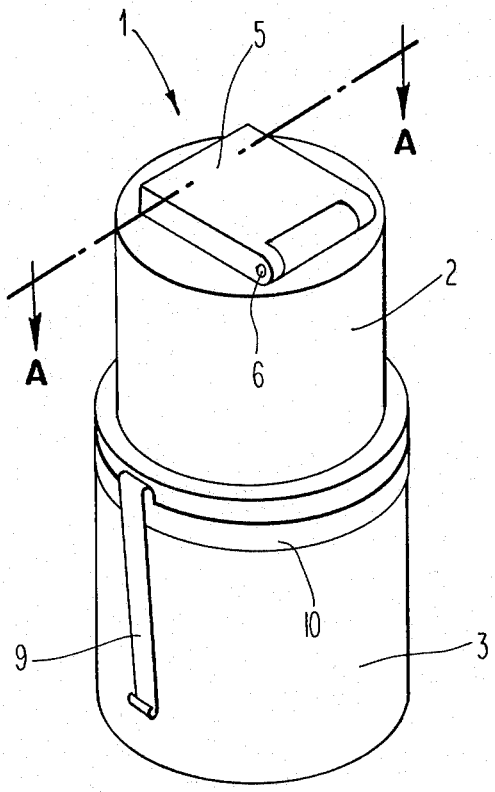
FIG. 1 is a perspective view of the present invention.
Figure 2:
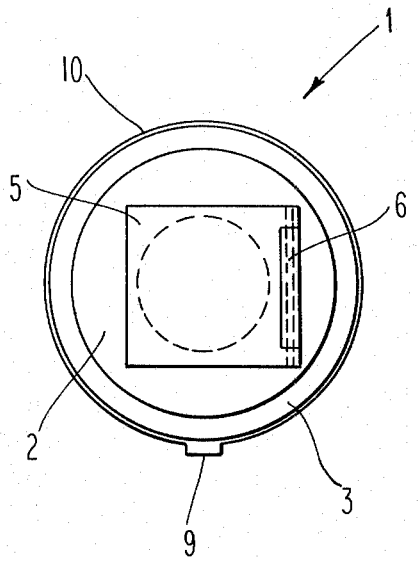
FIG. 2 is a top view along lines A—A of FIG. 1 with the top door closed.

The assembled preferred embodiment of the present invention is shown in FIG. 1. The invention is within case 1 which comprises an upper section 2 and a lower section 3 which are releasably connected to each other. The upper section has a receptacle 7 (shown in FIG. 3) which is accessible through door 5 which is hinged to the top of case 1 by hinges 6 or the like. The entire case can be clipped to a golf bag, cart or the like via clip 9 which is attached to lower case 3 via a circumferential board 10. The spring type clip is of conventional tension engagement configuration.

Figure 3:
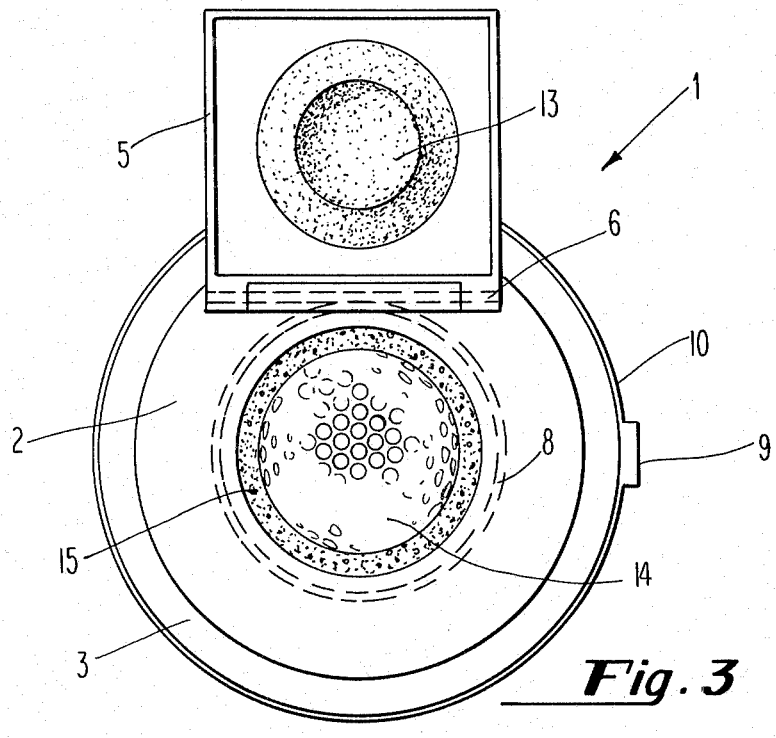
FIG. 3 is the top view with the door open.
Figure 4:
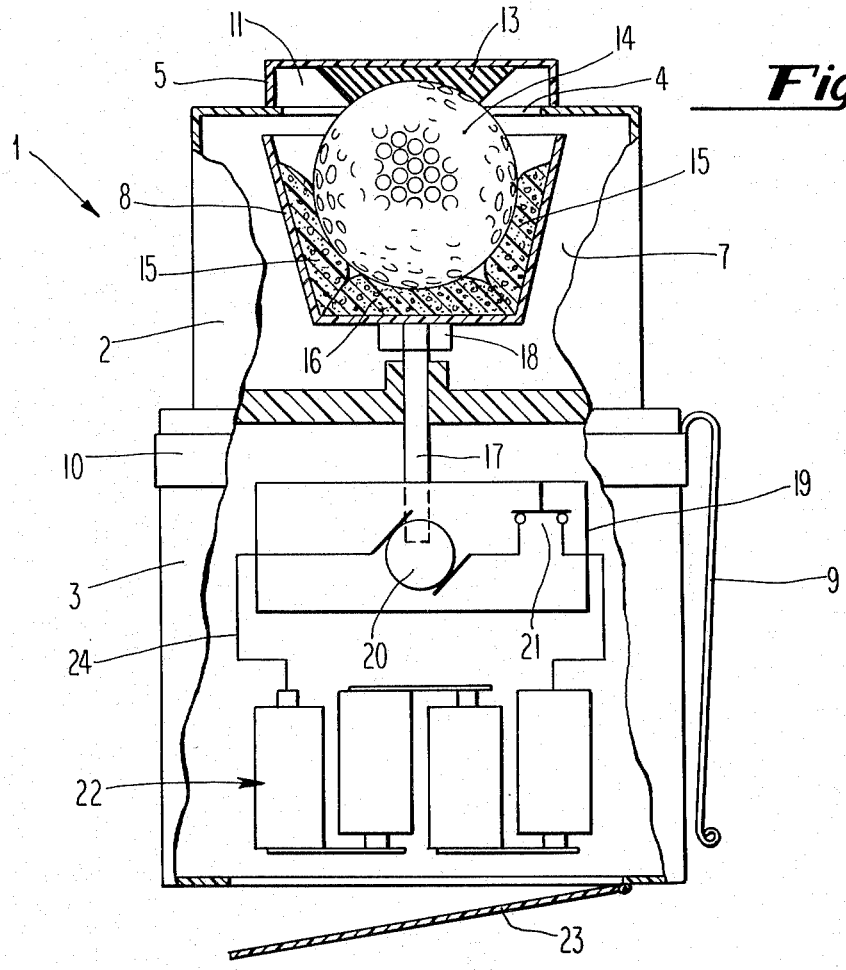
FIG. 4 is a sectional view showing the inter-related interior aspects of the present invention.

Referring to FIGS. 3 and 4, a closer look at the operative interiors aspects of the present invention and their interrelation can be had.

The upper section 2, of the case 1, held a receptacle 7 defined therein which in turn accommodates ball holder 8. The ball holder sits within this receptacle and is rotatable therein.

Within the ball holder are sponge-like members 15 which perform the scrubbing action on the ball. The bottom of the ball holder contains dish 16 in which the ball 14, sits when the washer is in operation.

In the preferred embodiment, the ball holder has a hexagonal fitting on the bottom of the outside thereof which is accommodating to a matching fitting on the shaft 17. The motor shaft engages this fitting to transmit motor rotation to the holder.

The ball 14, is placed into the holder 8 when door 5 closes, the inner top of the door accommodates the ball by door receptacle 11 and its rubber-like liner 13. The ball is then forced downward into the holder by the closing of the door. Further, the closing of the door causes switch 21 to close to complete circuit 24 thereby causing motor so to operate. In the preferred embodiment, this switch is actuated by a downward movement of the motor shaft 17, but other conventional switch actuation is also envisioned.

Actuation of the motor 20 causes shaft 17 and thereby holder 8 to rotate. Due to friction of the ball against liner 13 being greater than can be overcome by this rotation, the ball remains in a fixed location while the holder rotates around it. As a result, the sponge-like liner 15 scrubs the ball. It is anticipated that liner 15 can be impregnated with an amount of liquid cleaner to dampen and wash the ball.

The motor is powered by a portable source, 22, which is preferably a series of portable dry cell batteries. These can be readily changed by access through door 23.

The ball is removed after sufficient washing by allowing door 5 to open. It is preferred that door 5 is open in the "rest" position of the apparatus by having the switch mechanism resist closing. By opening and repositioning the ball, the sponge-like members 15 can be brought to bear on various surfaces of the ball.

It is preferred that item 15 will be constructed of a porous sponge which retains fluid and that the liner, 13 be of rubber or the like. It is preferred that the various parts of the device such as the case, receptacle and door be of a plastic material or the like, but this is not intended to limit the present invention to any particular material.

Although a preferred embodiment of the invention is shown, it should be understood that the invention is capable of variations and modifications from the form shown so that the scope thereof should be limited only by the appended claims.

I claim as my invention:

1. A portable golf ball washing apparatus comprising a. a case having a lower section and an upper section;

b. a ball receptacle defined in said upper which is accessible from the top of said upper section;

c. a hinged door on said upper section which seals said receptacle when closed;

d. a generally cylindrical, water-tight ball holder rotatably mounted in said receptacle and accommodatingly larger than a golf ball;

e. a liquid-retaining foam liner mounted within said ball holder;

f. a motor mounted in the lower section of said case;

g. means for transmitting said motor rotation to said ball holder;

h. a power source electrically connected to said motor by a circuit;

i. a switch in said circuit; and j. means for restraining the motion of a golf ball placed in the holder whereby the liner can move over the surface of the ball when the holder rotates.

2. The apparatus of claim 1 wherein the means for transmitting said motor rotating to said ball holder is a shaft fixedly attached at an end to the motor shaft and at the other end to the holder.

3. The apparatus of claim 1 wherein the means for restraining the motion of the golf ball is a rubber cup fixedly mounted on the inside of said door.

4. The apparatus of claim 3 which further comprises means for attaching said washed to a belt.

5. The apparatus of claim 4 wherein said means for attaching said washer is a spring-type clip.

* * * * *